United States Patent [19]

Allen

[11] Patent Number: 4,997,156

[45] Date of Patent: Mar. 5, 1991

[54] HOLDER FOR A BEVERAGE CONTAINER

[76] Inventor: Louis Allen, 166 E. 61 St., New York, N.Y. 10021

[21] Appl. No.: 381,176

[22] Filed: Jul. 17, 1989

[51] Int. Cl.[5] ..... A47K 1/09

[52] U.S. Cl. ..... 248/311.2; 248/289.1; 248/314; 248/231.5; 297/188

[58] Field of Search ..... 248/311.2, 312.1, 231.5, 248/290, 289.1, 314, 315, 229, 302; 297/188

[56] References Cited

U.S. PATENT DOCUMENTS

| | | | |
|---|---|---|---|
| 297,786 | 4/1884 | Goodman | 248/296 X |
| 1,151,920 | 8/1915 | Barton | 248/296 X |
| 1,345,252 | 6/1970 | Rubin | 248/311.2 X |
| 1,773,927 | 8/1930 | Mills | 248/99 |
| 2,235,986 | 3/1941 | Ellingson | 248/315 |
| 2,995,333 | 8/1961 | Pazzano | 248/230 |
| 3,096,961 | 7/1963 | Powell | 248/296 X |
| 3,116,046 | 12/1963 | Risdon | 248/231 |
| 3,370,820 | 2/1968 | Liss et al. | 248/311 |
| 3,640,494 | 2/1972 | Ruter | 248/314 X |
| 3,689,016 | 9/1972 | Hammon | 248/309.1 |
| 3,881,677 | 5/1975 | Ihlenfeld | 248/311 |
| 3,897,722 | 8/1975 | Harris | 248/311.2 X |
| 3,986,694 | 10/1976 | Nowak | 248/231.64 |
| 4,063,701 | 12/1977 | Wray | 248/293 |
| 4,560,128 | 12/1985 | Willeby et al. | 248/230 |
| 4,799,638 | 1/1989 | Allen | 248/311.2 |

FOREIGN PATENT DOCUMENTS

| | | | |
|---|---|---|---|
| 208446 | 12/1923 | United Kingdom | 248/311.2 |

*Primary Examiner*—Alvin C. Chin-Shue

[57] ABSTRACT

A holder for a beverage container is mountable on tubular chair legs or like members having wide-rangingly different angles of inclination and diameters. The holder provides for plumb positioning of a beverage container and for deterring tilting and toppling of the container. Preferably, a diameter-adjustable, container-encircling member provides for closely confining containers having different diameters. The holder includes a rotatably positionable mounting clamp member, a receptacle member and a connecting member, which connecting member angularly and pivotably associates the clamp member with the receptacle member, thereby providing for said plumb positioning of said receptacle member, moment deterrence to said tilting and dispositional deterrence to said toppling. Preferably, the connecting member and the receptacle member are integrally formed out of manually-bendable metal rod material, which provides for said adjustability of the continer-encircling member. The metal rod material preferably is plastic-covered through for insulating against temperature variations to which the metal is subject and for cosmetic purposes. Alternatively, the holder may be fabricated in whole or in part of plastic materials. The holder also provides for facilitating bottom-lifting of deformable paper cups for secure handling.

1 Claim, 2 Drawing Sheets

HOLDER FOR A BEVERAGE CONTAINER

FIELD OF THE INVENTION

This invention relates to beverage container supports, primarily to a holder for a beverage container attachable to outdoor chairs or the like.

BACKGROUND OF THE INVENTION

Though the prior art is replete with beverage container supports of one kind or another for one purpose or another, in the applicant's observation and experience, tubular chairs and lounges still suffer from the absence of a companion device adaptable for folding and non-folding chairs alike, for narrow cups and wide thermoses alike, that is sufficiently practical, effective and simple to handle the simple need of handling a drink in the great outdoors, where, for the most part, there is little in the way of beverage container support to be seen except for ground support, itself, often sloped, mostly inconvenient.

Plumbing these problems has induced the instant invention, a holder for a beverage container having a plumb-positionable, tilt-resistant, topple-resistant, preferably diameter-adjustable receptacle.

SUMMARY OF THE INVENTION

Briefly, the device of this invention concerns a holder for a beverage container adapted for attachment to a tubular chair member or the like.

The holder includes a receptacle member, a mounting member and a connecting member joining the aforesaid members.

The primary object of the invention is the provision of a simple, effective, economical holder, that provides for plumb positioning of a beverage container on tubular chair members having wide-rangingly different angles of inclination and also provides a tilt-resistant receptacle, which is preferably diameter-adjustable.

Another object of the invention is to provide a holder for a beverage container, which deters toppling of a beverage container.

Another object of the invention is to provide a holder for a beverage container, which provides for allowing bottom-gripping and lifting of a container for secure handling of a deformable paper cup.

Still another object of the invention is to provide a holder for a beverage container, that is releasable and adjustably securable to chair legs having rangingly different diameters.

Yet still another object of the invention is to provide a holder for a beverage container, that may remain attached during folding or carrying of a chair.

A yet still further object of the invention is to provide a holder for a beverage container, which is simple in construction, low in cost, reliable in use and well-adapted for mass production and fabrication techniques.

Other objects in part will become apparent and in part pointed out hereinafter.

With these ends in view, the invention finds embodiments in certain combinations of elements and arrangements of parts which the aforementioned objects and certain other objects are hereinafter attained, all as fully described with reference to the accompanying drawings and the scope of which is more particularly pointed out and indicated in the appended claims.

DETAILED DESCRIPTION OF THE PREFERRED EMBODIMENTS

Figure 1:
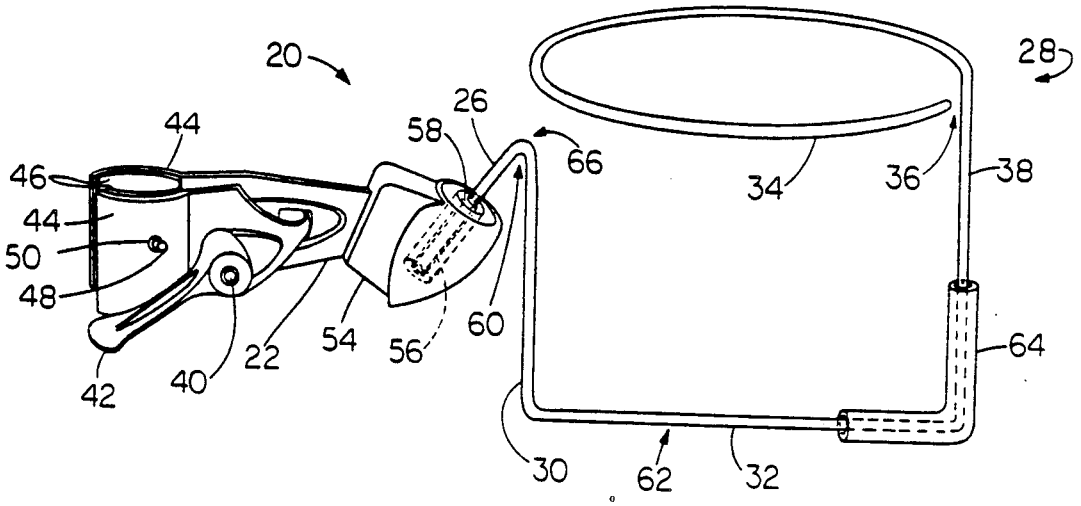
FIG. 1 is a perspective view showing a holder for a beverage container in accordance with the invention.

Referring now in detail to the invention, the reference numeral 20 denotes generally a holder for a beverage container in accordance with the invention.

The holder 20, as shown in FIG. 1, includes a clamp member 22, for mounting the holder 20 onto a tubular chair leg 24, a connecting member 26 and a receptacle member 28.

The receptacle member 28 includes a generally vertical suspension member 30 connected to a horizontal base member 32, a horizontal container-encircling member 34, leaving a gap 36 and a vertical spine member 38 joining the container-encircling member 34 with the base member 32 in a spaced relationship.

It should be seen that the suspension member 30 and the container-encircling member 34 are proximally disjoined, though alternatively they may be joined.

Figure 3A:
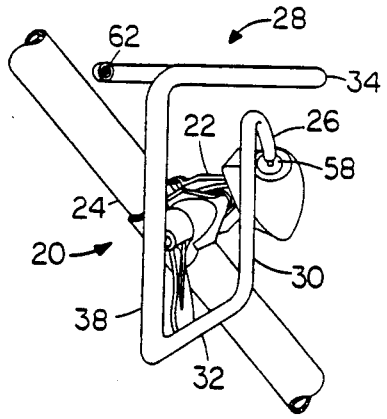
FIG. 3A is a perspective sideward view of the holder attached steeply-inclined chair leg showing the rotated mounting member clamped in position on the chair leg and the receptacle member pivoted into plumb position.
Figure 3B:
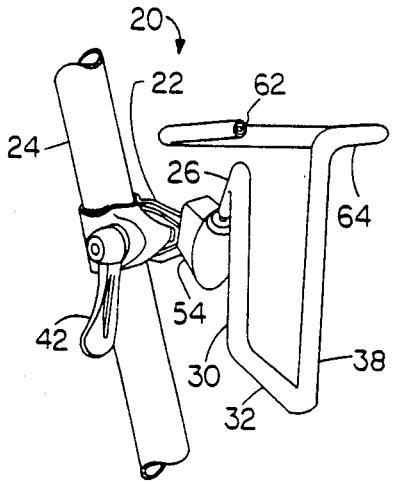
FIG. 3B is a perspective sideward view of the holder attached to a shallowly-inclined chair leg showing the rotated mounting member clamped in position on the chair leg and the receptacle member pivoted into plumb position.
Figure 3C:
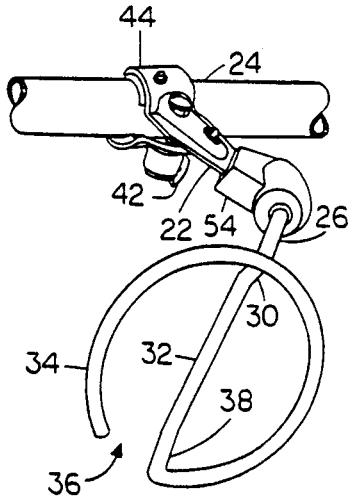
FIG. 3C is a perspective downward view of FIG. 3A.
Figure 3D:
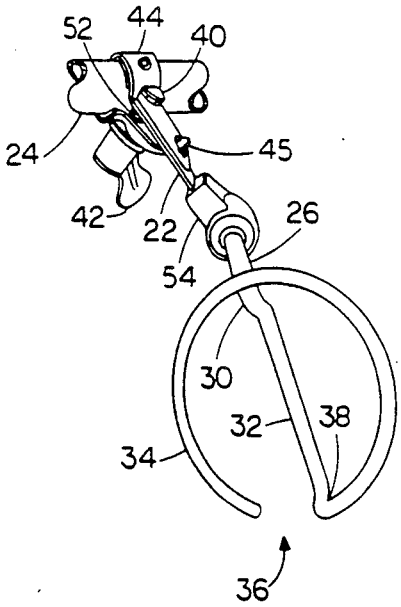
FIG. 3D is a perspective downward view of FIG. 3B.

As can be seen in FIG. 1, the mounting clamp member 22 is of a type well known in the art, using a threaded bolt 40 with a threaded lever 42 for opening and closing the jaws 44, joined at a fulcrum 45, as seen in FIG. 3D, providing for rotatable positionable securement on chair legs having different diameters. Rubber liners 46 are ringedly (not shown) attached around the threaded bolt 40 and are further anchored to respective jaws 44 by protrusions 48 extending from the liners 46 enhancing the clamping securement. A spring 52 surrounding the threaded bolt 40, shown in FIG. 3D, maintains a stabilizing tension between the otherwise loosely associated jaws 44.

The clamp member 22 is designed to be radially perpendicularly rotatable about the tubular chair leg and has an extension portion 54 with an angularly inclined socket 56 lined with a synthetic rubber bushing 58. The connecting member 26 fits tightly, releasably within the rubber bushing 58 and is pivotable therein. Releasability is optional. The bushing 58 may be of another material. The pivotable connecting member 26 extends non-vertically upwardly from the clamp member extension portion 54, thereafter forming a second non-perpendicular angle 60 connecting with the suspension member 30 of the receptacle member 28.

The clamp member 22 is metal. The extension portion 54 is plastic. The connecting member 26 and the receptacle member 28 are fabricated of one continuous length of hard, yet sufficiently manually-bendable metal rod material 62, which provides for the diameter of the container-encircling member 34 to be manually displaceably adjustable, while still tending to keep its general, fabricated shape. Contemplated in this regard is the close, secure confinement not only of typical beverage containers of different diameters, but also of currently popular mugs and considerably girthed foam insulators and thermoses. The gap 36, besides allowing diameter adjustability, also accommodates passage of mug handles.

The metal rod material 62, being rounded and insubstantial in girth, allows the four finger tips of the hand to pass, caterpillar-like, relatively unobstructedly over the container-encircling member 34, allowing for advantageous bottom-lifting of paper cups, which, when laden and lifted from near the top, can deform yieldingly, precariously to the grip. The container-encircling member 34 of the preferred embodiment shown is elliptically shaped, though it could be circular.

A tubal plastic covering 64, a portion of which is shown in FIG. 1, covers entirely the metal rod material 62 of the holders 20 shown in FIGS. 3A–3D, providing insulation against metal temperature changes and for cosmetic purposes. Alternatively, dipped plastic coating or other coverings could be employed.

It should be seen that the holder 20 may alternatively be fabricated in whole or in part of plastic or other materials or in hybrid combinations of such materials and may vary from the shapes shown, as, for example, where some of the rod-shaped material 62 might be substituted for by flat or oblong-shaped plastic materials.

Figure 2:
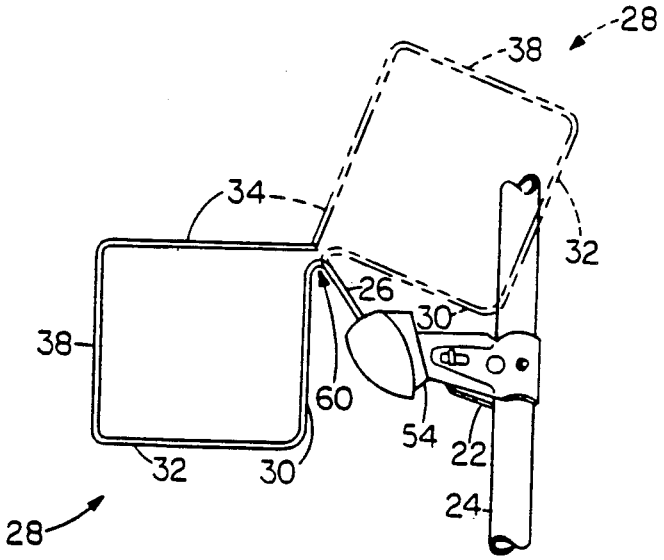
FIG. 2 is a perspective frontal view of the holder attached to an angularly inclined chair leg illustrating the rotational pivoting action of the connecting member and the conical traversability of the receptacle member.

Referring now to FIG. 2, demonstrated is the pivoting action of the connecting member 26 and the receptacle member 28. As described, the connecting member 26 pivots within the socket 56 and extends angularly upwardly non-vertically. Though different such non-vertical angles can be used, the preferred embodiment employs an angle of 50 degrees measured off the horizontal axis of the clamp member 22, which horizontal axis is generally parallel with the horizontal axis of the base member 32, though said axes need not necessarily be so related. Said second angle 60 provides the vertex for axially conical traversability of the receptacle member 28 in pivoting. The angle 60, being less than perpendicular, further provides less moment to the receptacle member 28 for tilting than a comparable receptacle would have perpendicularly pivoting on a horizontal axis.

Further, in the extreme instance, where the receptacle member 28 might be forced 180 degrees into an upside-down position, opposite its functional position, as shown by the phantom lines in FIG. 2, the vertical axis of the receptacle member 28, embodied in, for example, the spine member 38, can be seen as it would be, that is, in an upwardly inclined, but non-horizontal position, unlike container-discharging positions a receptacle rotating on a horizontal axis would present.

The holder 20 should thus be seen not only as having moment means for resisting accidental tilting of the receptacle member 28, but also a back-up means for deterring toppling of a container in said extreme instance of a 180 degree rotation from a functional position. The receptacle member 28 would still not assume said container-discharging positions commencing at over 90 degrees rotation in a horizontally-axised receptacle.

Another aspect of the invention can also be seen in the hook-like formation 66 provided by the connecting member 26 associating the clamp member 22 with the suspension member 30, which hook-like formation 66 prevents accidental sideward release of the connecting member 26, to which accident a horizontally axised receptacle might be subject, absent some sort of deterrent mechanism, especially under the leveraged weight of a beverage, particularly one in an outwardly tilted position not easily recognized from a seated position.

Turning now to FIGS. 3A–3D, in FIG. 3A the clamp member 22 has been rotated and is clampingly positioned on a steeply angularly-inclined chair leg 24, and similarly in FIG. 3B on a shallowly angularly-inclined chair leg 24. Among other things, FIGS. 3A and 3B show the facility of the holder 20 in accommodating wide-rangingly different chair leg 24 angles of inclination, the leg angle of FIG. 3A being approximately 40 degrees off vertical, the leg angle of FIG. 3B being approximately 15 degrees off vertical, a popular angle.

FIG. 3C being a downward-looking view of FIG. 3A and FIG. 3D being a downward-looking view of FIG. 3B, it should be observed that, depending on the angle of inclination of the particular chair leg 24, the clamp member 22 is rotated to that specifically pitched point particular to that particular angle of inclination, whereat, in concert with pivoting the receptacle member 28, the conically traversable base member 32 can be pivotably positioned parallel to the horizon, that is, plumb, on chair legs having any angle of inclination within a given range.

In the preferred embodiment, chair legs ranging from vertical to angularly inclined of approximately 70 degrees from vertical are accommodatable for plumb positioning the receptacle member 28 advantageously in the quadrant generally forwardly-to-sidewardly adjacent the attached clamp member 22, said receptacle member 28 being thereby unobstructive to a chair entrance and providing for convenient user access to a beverage.

It should be seen that said angular range of leg members need not be bounded by a vertical leg necessarily, but may start at an inclined angle.

If one considers again FIG. 3B and if one visualizes the sideward view angle of inclination of the leg 24 thereshown instead as a front view, wherein the leg 24 is leaning sidewardly, it should be observable that plumb positioning of the receptacle member 28 on a chair tilted to any even remotely seatable position is an object of the invention easily realized.

It should thus be seen that the holder of this invention provides an improved and efficient device for accommodating a beverage container on an angularly inclined tubular member and that it is well adapted to meet the conditions of practical use. Since various possible embodiments may be made of the instant invention and further changes may be made in the exemplary embodiments set forth herein, it is to be understood that all material set forth or shown in the accompanying drawings are to be interpreted as illustrative and not in a limiting sense.

Having thus described the invention, there is claimed as new and desired to be secured by Letters Patent:

1. A holder for a beverage container for releasable securement to an outdoor chair leg member, said holder comprising, a mounting means having a clamping member with pivotable jaws at one end rotatably secured to said leg member about a longitudinal axis of an opening of said jaws, an extension portion fixed to the other end of said clamping member and having an inclined socket with a longitudinal axis of said socket forming an acute angle with the longitudinal axis of said opening, a receptacle means including a horizontal container-encircling means, a vertical spine member, joining said horizontal container-encircling means with a horizontal base member in spaced relationship, a suspension member extending vertically upwardly from said base member, a downwardly extending connecting member connected to an upper portion of said suspension member and forming an acute angle therewith, said connecting member being secured within said socket, wherein said receptacle means is pivotally supported on said mounting means, and may be pivoted in a conical motion with respect to said longitudinal axis of said socket for providing plumb positioning of said receptacle means when said holder is mounted on angularly-disposed leg members within a given range.

* * * * *